United States Patent [19]

Wang

[11] 4,345,765

[45] Aug. 24, 1982

[54] MOVING TARGET MEANS OF SHOOTING GALLERY

[76] Inventor: Austin Wang, No. 3, 5th Alley, 5th La., 1st Sec. Chung-Ching S. Rd., Taipei, Taiwan

[21] Appl. No.: 166,900

[22] Filed: Jul. 9, 1980

[51] Int. Cl.[3] ..... F41J 9/02

[52] U.S. Cl. ..... 273/359; 46/44; 273/365; 273/369

[58] Field of Search ..... 273/365, 350, 359, 370, 273/355, 372, 357, 393, 412, 399, 369, 356, 398, 349, 400, 362, 401, 402; 46/44

[56] References Cited

U.S. PATENT DOCUMENTS

| | | | |
|---|---|---|---|
| 2,793,038 | 5/1957 | Wallace et al. | 273/372 X |
| 3,115,343 | 12/1963 | Lemelson | 273/359 X |
| 3,869,123 | 3/1975 | McDaniel | 273/359 |
| 4,090,713 | 5/1978 | DeCesare | 273/86 B |

FOREIGN PATENT DOCUMENTS

| | | | |
|---|---|---|---|
| 2258353 | 2/1974 | Fed. Rep. of Germany | 273/399 |
| 567880 | 10/1957 | Italy | 273/393 |

*Primary Examiner*—Paul E. Shapiro

*Attorney, Agent, or Firm*—Lane, Aitken, Kice & Kananen

[57] ABSTRACT

The present invention relates to a mechanism for providing air-supported floating lightballs as moving targets in shooting galleries in which the height of the lightballs is constantly changed by varying the current passing through associated air pumps that produce air jets for lifting the lightballs in the air by changing the resistance of the current path by means of a rotating rheostat disc, thereby providing the lightballs with an unpredictable and capricious nature.

8 Claims, 5 Drawing Figures

MOVING TARGET MEANS OF SHOOTING GALLERY

BACKGROUND OF THE INVENTION

Conventional shooting galleries with floating lightballs as moving targets suffer various drawbacks as follows:

1. Since in conventional shooting galleries, a vertical jet of water is applied to lift and support a lightball in the air, the corks (or rubber plugs) used as the cartridges of the dummy shotguns are always moistened when passing through the water spout. A wet cork, unless cleaned and dried before reuse, is liable to cause rust in the muzzle and the piston of the dummy shotgun. Moreover, dirt tends to adhere to a wet cork far more than to a dry one. For this reason, the shooters must clean a cork whenever it hits a water spout, and this considerably reduces the amusement valve of the game.
2. The fluctuation of the water-supported lightball results from the perturbation of the hydraulic pressure which varies at random and is beyond the control of designers. Again, this manner of supporting the lightball provides a relatively small range of fluctuation, and fails to offer the players enough excitement.
3. Such kind of devices consumes water. Although the ejected water can be refluxed for water-saving sake, periodic replenishment of the water is still needed due to the loss by evaporation which occurs much faster in ejected water than in still water.
4. Whatever type the water-supported floating ball mechanisms may be used, with or without reflux system, the conventional shooting gallery devices is too large, for the former requires a water supply system and a drainage system, whereas the latter, a recycle system, therefore both are too bulky and cumbersome to adapt to family use, not including the trouble that the applied water may spoil the accommodations such as carpets, rugs, or wall papers.

Accordingly, it is the goal of the invention to provide a low cost means to obviate and mitigate said defects of conventional shooting galleries described above.

It is another object of this invention to provide one kind of air-supported floating ball devices to supercede the conventional ones both to simplify the construction and to relieve the hazards of water staining of household accommodations, to thereby adapt the floating ball device to domestic use.

It is a further object of the present invention to provide one kind of shooting gallery device that allows a relatively larger amplitude of fluctuation of the floating ball to enhance the amusement valve it can offer.

SUMMARY

The present invention relates to gas-supported shooting moving target devices for shooting galleries, and, more particularly, to one that is provided with a rotatable rheostat disc which varies the electric current passing through a plurality of air pumps that produce an upward jet of gas to support their respective lightballs as moving targets at intervals, thereby resulting in a capricious fluctuation of the height of said lightballs to enhance the amusement valve of the game.

Numerous other features, objects, and advantages of the invention will become apparent from the following specification when read in connection with the accompanying drawing in which:

BRIEF DESCRIPTION OF THE DRAWING

FIG. 2-A is an enlarged view of a wedge unit;

DETAILED DESCRIPTION OF PREFERRED EMBODIMENTS

Figure 1:
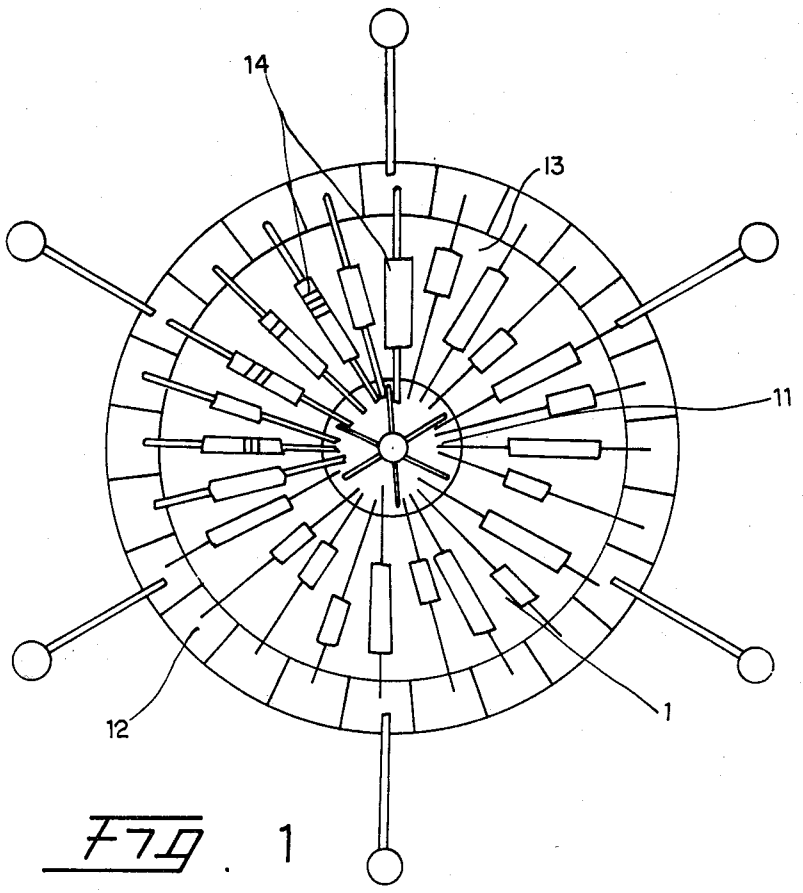
FIG. 1 is the top view of the rotating rheostat disc of this invention.
Figure 2:
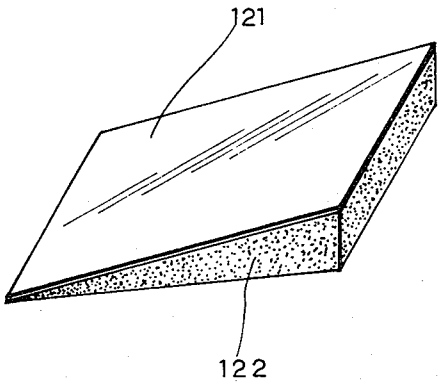
FIG. 2 is the an enlarged graphical representation of the rotating rheostat disc.
Figure 2:
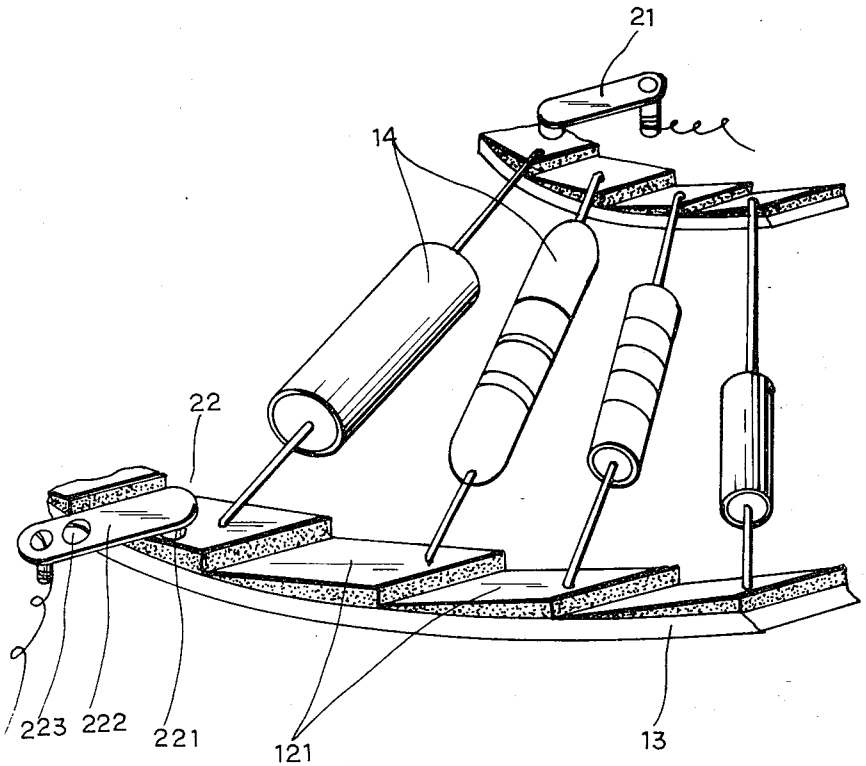

With reference now to the drawing, particularly FIG. 1 thereof, a rotating rheostat disc (1) comprises basically an inner and an outer metal-plated ring (11) (12), respectively, secured in place on an insulating disc (13) formed from a non-conductive material rotatably mounted on the whole apparatus, and a plurality of resistors (14) differing in resistance interconnecting said inner and outer metal-plated rings (11) (12). As shown in FIG. 2, the outer ring (12) is formed by a number of metal plates (121), which are spaced around the circumference of the insulating plate (13) in a pleated manner with the plane of each metal plate (121) dipping to the direction in which the rheostat disc (1) turns, so that each metal plate (121) is not in electrical contact with its adjacent ones. The outer ring (12) may be formed by fixing individual wedge units that comprise a metal plate (121) and an attached insulating wedge-shaped base (122) onto a flat insulating disc (13), or more preferably, by attaching the metal plates (121) directly in position to a pleated rim which is formed integrally together with the insulating disc (13). The inner ring (11) can be either an integral metal ring, or a pleated ring similar to the outer ring (12). Resistors (14) straddle across the inner and outer ring with both the ends of each resistor soldered thereonto, thus forming the "spokes" of the wheel-like structure.

Figure 3:
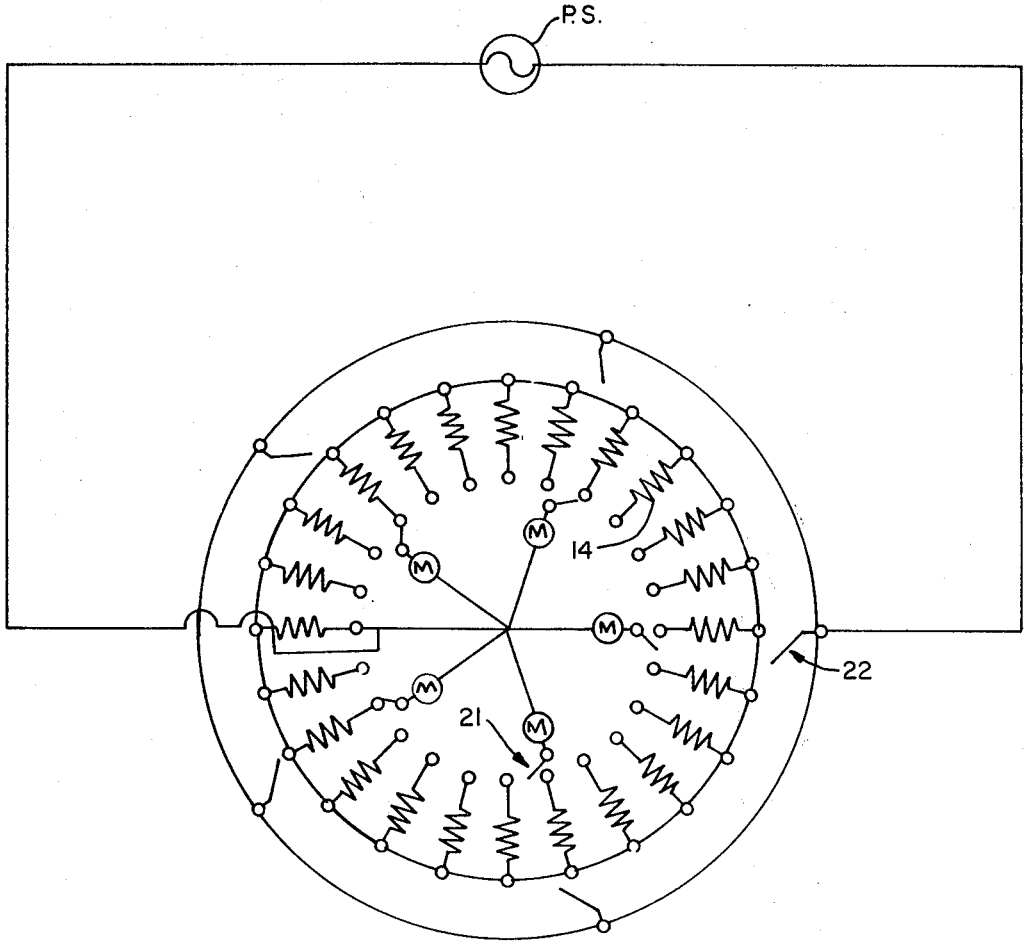
FIG. 3 is the wiring diagram of this invention.

A plurality of inner contacts (21) and outer contacts (22) are located radially with respect to the rotatable rheostat disc, and make contact, respectively, with the inner ring (11) or the outer ring (12). Preferably, both of the inner contacts (21) and outer contacts (22) are so designed that they always establish good contact with their respective metal-plated rings (11) and (12) despite the rotation of the rheostat disc (1) or the wear of the contact points (211). For example, the contacts (22) can be designed to offer the contact points (221) a downward pressure by the resumptive force of the metallic strip (222). The pressure exerted by contact point (221) on metal plate (121) can be adjusted by turning the adjusting fastener (223). The number of either the outer contacts (22) or the inner contacts (21) is equivalent to that of the air pumps. Wires in electrical connection with both the inner contacts (21) and the outer contacts (22) are connected to a power source PS and corresponding air pumps M respectively, as shown in the schematic circuit diagram of FIG. 3 according to this invention. However, it must be announced that all the aforementioned only help the Examiners to understand this invention, and do not mean to demarcate the domain thereof.

Having thus described the construction and layout of the heart of the moving targets according to the present invention, i.e. the rotatable rheostatic disc, we now provide a description of the operation thereof. Since the rotatable rheostatic disc spins very slowly, the slight "delay" of the response of the pump to the changing current due to the varying resistence is inappreciable from a macroscopic view.

Note that the value of resistances 14 is not the only factor which affects the height at which a lightball strays in the air. The pressure that the contact point (221) exerts on the metal plate (121) may more or less cause a slight increase or decrease of the resistance when the contact point is in contact with the same metal plate. The resistance is lower for a contact point (221) pressing on the high margin of a metal plate than for a contact point pressing on the low margin thereof. For this reason, the flow rate of the air jet is always changing and endows the lightball with an unpredicable, capricious nature. Inasmuch as the lightballs are supported by the intangible and invisible air jet, it seems as if someone is performing witchcraft to maintain them in the air, thus offering a high interest which is by no means what the water-supported moving targets can provide or compare with.

Figure 4:
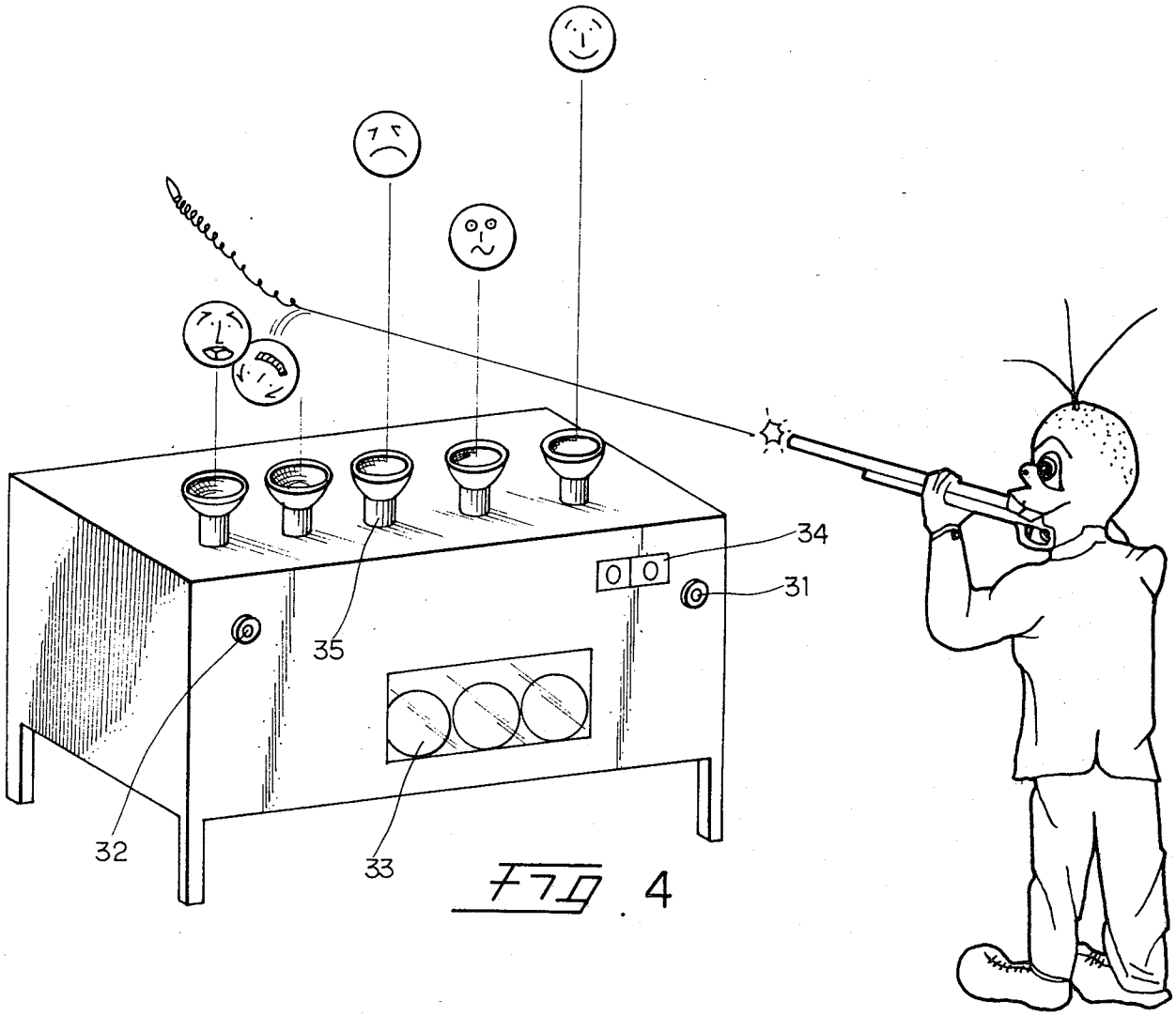
FIG. 4 is an embodiment of this invention.

With reference now to the preferred embodiment in FIG. 4, wherein there is shown a miniature shooting gallery according to this invention with a board painted with a landscape as the background. Knob (31) controls the rotation speed of the rheostat disc (1) while timer knob (32) is used to set the duration that the air pumps operate. In case two players decide to see which of them can shoot off more lightballs within a definite period, say one minute, then they can set the knob (32) to the position of one minute which results in the stopping of the air pumps after one minute. The lightballs that are not shot down will fall and rest in the receptacles (35), while the lightballs that are hit will fall into a slant gutter (not shown) and roll to the collector (33). In its route rolling along the gutter, the lightball may touch and trigger the switch of the score displayer (34) indicating how many lightballs a player has shot down and add to the number thereof. All these are well known arts and not included in the Claims, hence a further description is unnecessary.

Considering all the above mentioned, this invention has been shown to have numerous advantages over known devices for shooting galleries using lightballs as the moving targets. With the use of the relatively simple construction of a rheostat disc, the joy and excitement of hunting are obtained due to the capricious and unpredicable nature of the lightball. Apart from providing a highly interesting amusement, it means a lot in terms of the educational value and national defence. From the point of view, the novelty and practicality of the present invention is beyond question.

It will be apparent from the foregoing description of my invention, that the same is subject to alteration and modifications without departing from the underlying principles involved, and I accordingly, do not desire to be limited to the specific details illustrated and described except as may be necessitated by the appended claims.

What I claim:

1. A moving target mechanism for shooting galleries comprising:

a plurality of air pump means for producing a plurality of individual vertical air-jets;

a lightball supported on each air jet; and means for continuously varying the current passing through each air pump means to continuously change the flow rate of each air jet whereby the height of support of each lightball is varied continuously.

2. The mechanism according to claim 1 wherein said means for varying the current passing through each pump functions to change the resistence of the path which the current passes through.

3. The mechanism according to claim 1, in which means for varying the current comprises a rotatably mounted rheostat disc.

4. The mechanism of claim 3 wherein said rheostat disc comprises a disc of insulating material, an inner ring of metal and an outer ring of metal plates mounted on said disc in electrically isolated positions, and a plurality of resistors interconnecting plates in said outer ring to said inner ring.

5. The mechanism of claim 4 wherein said metal plates slant downwardly toward the direction of rotation of said disc, and each plate in said outer ring is connected by a resistor to said inner ring.

6. The mechanism of claim 5 further comprising a plurality of electrical contacts in electrical contact with said inner ring and a plurality of electrical contacts in electrical contact with said outer ring.

7. The mechanism of claim 6 wherein the number of inner and outer contacts and air pumps is equal.

8. The mechanism of claim 6 further comprising resilient means for biasing said contacts against said rings.

* * * * *

UNITED STATES PATENT AND TRADEMARK OFFICE

CERTIFICATE OF CORRECTION

PATENT NO. : 4,345,765

DATED : August 24, 1982

INVENTOR(S) : AUSTIN WANG

It is certified that error appears in the above—identified patent and that said Letters Patent is hereby corrected as shown below: On the title page Item 54, Title of the Invention should read -- MOVING TARGET MEANS SHOOTING GALLERY --

Column 1, lines 1 and 2, the title of the invention should read -- MOVING TARGET MEANS SHOOTING GALLERY --;

Column 1, line 21, "valve" should read -- value --;

Column 1, line 57, "valve" should read -- value --;

Column 1, line 69, "valve" should read -- value --;

Column 2, line 9, "the" should be deleted;

Column 3, line 4, "resistence" should read -- resistance --;

Column 3, line 8, "strays" should read -- stays --;

UNITED STATES PATENT AND TRADEMARK OFFICE

CERTIFICATE OF CORRECTION

PATENT NO. : 4,345,765

DATED : August 24, 1982

INVENTOR(S) : AUSTIN WANG

It is certified that error appears in the above—identified patent and that said Letters Patent is hereby corrected as shown below:

Column 3, line 16, "unpredicable" should read -- unpredictable --; and

Column 4, line 2, "defence" should read -- defense --.

Signed and Sealed this

Fourth Day of January 1983

[SEAL]

Attest:

GERALD J. MOSSINGHOFF

Attesting Officer

Commissioner of Patents and Trademarks